United States Patent [19]

Olson

[11] 4,036,464

[45] July 19, 1977

[54] HEADSET HANGER

[76] Inventor: Steven W. Olson, 8011 N. New Braunfels, No. 117, San Antonio, Tex. 78209

[21] Appl. No.: 688,034

[22] Filed: May 19, 1976

[51] Int. Cl.[2] ..... A47F 5/08

[52] U.S. Cl. ..... 248/309 R; 248/89

[58] Field of Search ..... 248/304, 309, 217, 75, 248/89; 179/156 R, 146 R; 211/105.1, 32

[56] References Cited

U.S. PATENT DOCUMENTS

| | | | |
|---|---|---|---|
| 69,311 | 10/1867 | Brown | 248/304 |
| 378,201 | 2/1888 | Jacoby | 248/304 |
| 684,312 | 10/1901 | Rush | 248/304 X |
| 1,115,730 | 11/1914 | Oswalt | 248/304 |
| 2,679,998 | 6/1954 | Keller | 248/304 X |
| 3,353,779 | 11/1967 | Baker | 211/105.1 X |
| 3,837,608 | 9/1974 | Simon | 248/205 A |
| 3,946,877 | 3/1976 | Galicia | 248/205 A |

FOREIGN PATENT DOCUMENTS

| | | | |
|---|---|---|---|
| 1,102,214 | 7/1959 | Germany | 179/146 R |

*Primary Examiner*—J. Franklin Foss

[57] ABSTRACT

This invention relates to a headset hanger that may be mounted near stereo equipment, in homes, studios, etc., to keep headphones from being damaged or misplaced. A unitary molded hanger is shown having means for retaining the headband in fixed position, and having means for attaching to a wall or other structure for mounting with respect thereto.

5 Claims, 3 Drawing Figures

HEADSET HANGER

BACKGROUND OF THE INVENTION

This invention relates generally to a novel support adapted for use in connection with a headset or the like, and is particularly directed to novel easily mountable brackets, supports and hangers adapted to keep headphones from being damaged or misplaced during storage.

Headphones are used for a variety of reasons in the home or by professionals, to listen to sound that may stem from a radio, television set, telephone, or stereo equipment, etc. Headphones or headsets are generally designed to be as light as possible in order to be comfortable to wear by the user. Towards this end the headband portion is curved to conform to the contour of the user's head with one or two ear microphones connected to the headband for covering the ear's of the user. Due to the inherent design configuration of the headset one is left with an item of an odd shape that is difficult to store when not in use. Furthermore, to keep the weight of the headset as low as possible for comfort reasons, results in the fact that it can readily be bent out of shape unless proper storage of the headset is provided for. The storage of the headset is further complicated by the fact that a coiled or regular connecting cord is connected thereto. The cord which may extend for several feet, may weigh more than the headphones and has a tendency to pull the headphones from its stored position unless the headset is firmly held in position.

OBJECTS OF THE INVENTION

It is an object of the present invention to provide an improved support for the storage of headsets or the like.

Another object of the invention is to provide a simple unitary hanger for headphones which securely retains the headset in place without requiring any movable parts or spring biased retaining means.

Another object of the invention is to provide a bracket which will substantially seat a headset which is positioned only very approximately in the bracket.

Another object of the invention is to provide a headset support bracket which in addition to holding and readily seating the headset which is positioned only very approximately in the bracket, provides ready removal of the headset without having to overcome any restraining forces.

Another object of the invention is to provide a unitary structure that does not require expensive manufacturing processes.

Other objects of the invention will become obvious as the disclosure proceeds.

SUMMARY OF THE INVENTION

The improved headset holder of the present invention comprises a unitary moulded structure having means for abutting a wall or other surface with an outwardly extending support means for receiving the headband portion of the headset thereon. To prevent the headband from slipping off from the support means, spaced apart projection or retaining means extending upwardly from the support means is utilized. To prevent the cord or the headset from getting tangled, downwardly extending hook means is provided. To secure the holder to a wall or other surface, coupling means associated with the abutting means is provided.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DESCRIPTION OF THE PREFERRED EMBODIMENTS

Figure 1:
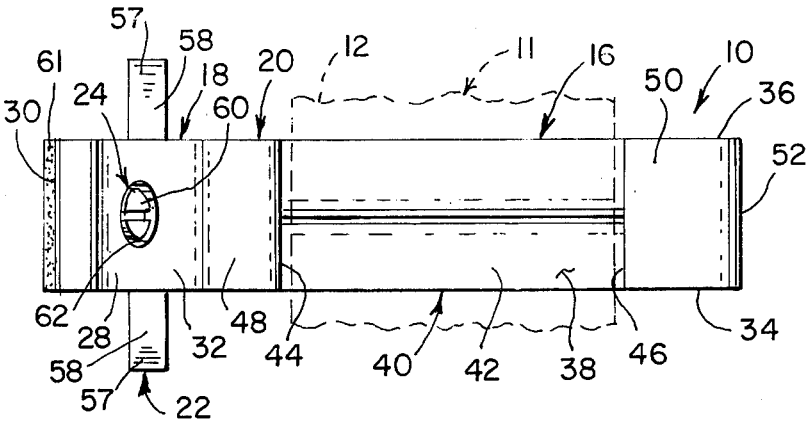
FIG. 1 is a top plan view of the headset hanger, a portion of the headset being shown in broken lines.
Figure 2:
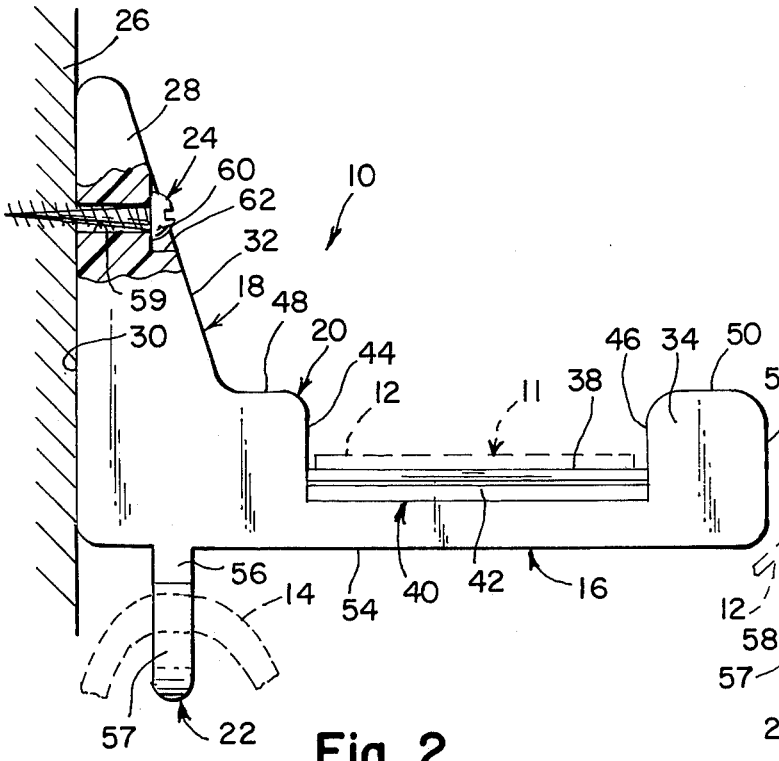
FIG. 2 is a side elevation view, partly in section, of the hanger seen in FIG. 1.
Figure 3:
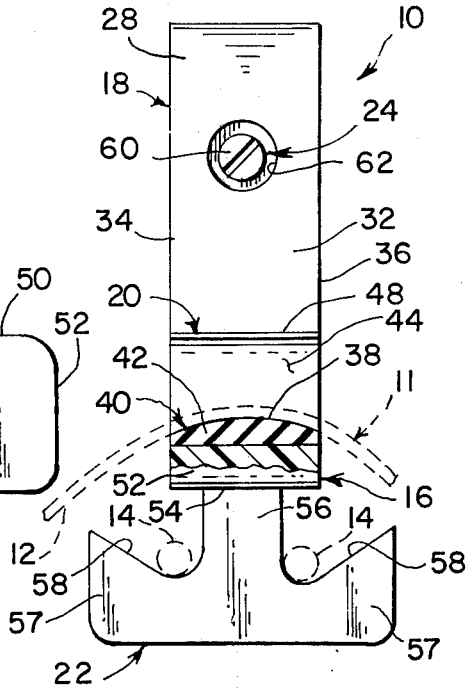
FIG. 3 is a front elevation view of the hanger seen in FIG. 1.

Referring now to FIGS. 1 through 3, there is illustrated a hanger or bracket 10 that may be used to support all types of headsets 11 (partially illustrated in phantom) that includes a headband portion 12, and a coiled or regular connecting cord 14, with one or two earphones (not shown) connected to the headband 12 and electrically connected to the cord 14. The hanger 10 may be integrally formed out of a moulded plastic material due to the economic ease of manufacture in a variety of finishes or colors.

The hanger 10 includes support means 16, abutting means 18, spaced apart retaining means 20, downwardly extending hook means 22, and coupling means 24; all interrelated with each other in a cooperating manner hereinafter described in detail.

The hanger 10 is designed for engagement with a wall 26 or other surface as in a cabinet, etc. The abutting means 18 includes an upwardly extending body portion 28 having a rear contacting surface 30 for engagement with the wall 26. An upwardly extending front face 32 may be inclined relative to the contacting surface 30 and having spaced apart side surfaces 32 and 34 that may extend parallel to each other over the complete width of the hanger 10.

The support means 16 may be integrally formed with the abutting means 18 and extend outwardly therefrom a distance sufficient to receive thereon the headband 12 of the headset 11. A contoured support surface 38 may be integrally formed as part of the support means 16 and contoured for engagement with the arched surface of the headband 12. The support surface 38 may engage the headband 12 along its entire surface or at portions thereof.

To assure a minimum amount of movement between the headset 11 and support means 16, friction means 40 may be employed. The friction means 40 may be in the form of a texturing of the surface 38 or the use of a friction pad or inset 42 as best illustrated in FIG. 3. The friction means 40 is designed to provide a high coefficient of friction at the surface of contact between the headband 12 and support means 16. As best illustrated in FIG. 3 the concave support surface 38 approximately conforms to the angle of curvature of the headband 12 positioned thereon.

The spaced apart retaining means 20 extends upwardly from the support means 16 for receiving the headband portion 12 therebetween and maintaining same in place to prevent any substantial lateral movement. The receiving slot formed by the upwardly extending spaced apart walls 44 and 46 have a width slightly greater than the dimension of the headband 12 so that lateral movement is prevented. The walls 44 and 46 terminate in upper edges 48 and 50 that may be in a common plane. The depth of the recess defined by walls 44 and 46 require the user to lift the headset 11 out of its seated position before use thereof. The upper edge 48 may blend into the inclined front surface 32 and the upper edge 50 may terminate at the front wall or edge 52 of the hanger 10. The upper edges 48 and 50 may extend in parallel spaced relation to the bottom wall or edge 54 of the hanger 10.

Downwardly extending hook means 22 is utilized for retaining the cord 14 in place and may be integrally formed with the abutting means 18 and formed having a post 56 terminating in a pair of spaced apart depending lugs or arms 57 that form a double hook for retaining the cord 14 in fixed position. The lugs 57 each have a downwardly extending inclined surface 58 converging towards each other and forming an open top trough for the cord 14 to pass therethrough. In this manner to release the cord 14 from its seated position as illustrated in FIG. 3 an upward and outward movement is required to lift the cord 14 above the open top of the trough. The trough is defined in part by the inclined surfaces 58 that extend in a plane transversely to the surface 38 of the support means 16.

The coupling means 24 is positioned in operative relation with the abutting means 18 for securing the hanger 10 in fixed position so that the contacting surface 30 stays firmly in position against the wall 26 when the weight of the headset 11 is applied to the hanger 10. A transversely extending aperture 59, between surfaces 30 and 32, as illustrated in FIG. 2, has a fastener 60, illustrated in the form of a screw extending through the aperture 59 into the wall 26. A seat 62 is provided on wall surface 32 for the head of the fastener 60.

An alternate form of coupling means is illustrated in FIG. 1, and may be used by itself or in conjunction with the form previously illustrated. This alternate form may be a double adhesive tape 61 firmly secured to the surface 30 and the wall 26 for permanent engagement with respect thereto.

Accordingly, two options for mounting the headset holder to the desired surface are disclosed. The peel and stick backing adhesive can hold approximately 5 pounds.

A suitable size of the hanger 10 is one in which the length between surface 30 and front wall 52 is about four and one half inches and about one inch wide between side surfaces 34 and 36. The support surface is about two and one half inches wide between vertical walls 44 and 46 with a height to the upper edge 48 and 50 of one half inch.

Although illustrative embodiments of the invention have been described in detail herein with reference to the accompanying drawings, it is to be understood that the invention is not limited to those precise embodiments, and that various changes and modifications may be effected therein without departing from the scope or spirit of the invention.

I claim:

1. A hanger adapted to be mounted on a wall or other surface for supporting a headset having a headband and a headphone coupled thereto with a cord surface to the headset comprising:

A. abutting means having a contacting surface for extending along a side of a wall or other surface;

B. support means for receiving the headband portion of the headset thereon and extending outwardly from said abutting means and having a pair of oppositely disposed side surfaces;

C. said support means has a concave curved support surface to approximately conform to the angle of curvature of the headband positioned thereon;

D. spaced apart retaining means extending upwardly from said support means for receiving the headband portion therebetween so as to contain said headband on said support means;

E. said spaced apart retaining means forms a receiving slot having a width slightly greater than the dimension of the headband therebetween, such that lateral movement of the headband on the holder is restricted;

F. downwardly extending hook means for retaining the cord of the headset in place during storage, said hook means integrally formed with said abutting means;

G. said downwardly extending hook means includes a pair of spaced apart depending lugs terminating beyond said oppositely disposed side surfaces, each of said lugs having a downwardly extending inclined surface converging towards each other and forming an open top trough for the cord, such that to release the cord from its seated position, an upward movement is required to lift the cord above the open top of the trough, said lugs being in alignment with each other with said inclined surfaces substantially disposed in a plane normal to said contacting surface, and H. coupling means in operative relation with said abutting means for securing the holder in fixed position, such that said contacting surface of said abutting means engages the wall or other surface.

2. A hanger as in claim 1, and further including friction means forming part of said support means which provides a high coefficient of friction at the surface of contact between the headband and said support means.

3. A hanger as in claim 1, wherein said coupling means is in the form of an aperture extending transversely through said abutting means for receiving a fastener to retain the hanger in fixed position relative to the wall or other surface.

4. A hanger as in claim 1, wherein said coupling means includes an adhesive member firmly coupled to said contacting surface and having a spaced apart adhesive surface for permanent engagement with the wall or other surface to retain the hanger in fixed position relative thereto.

5. A hanger as in claim 2, wherein said friction means includes a pad secured to said support means within said receiving slot for supporting the headband thereon.

* * * * *